US011597584B2

(12) United States Patent
Johns et al.

(10) Patent No.: US 11,597,584 B2
(45) Date of Patent: Mar. 7, 2023

(54) METHOD AND APPARATUS FOR DELIVERING FLUID TO AN INDIVIDUAL

(71) Applicants: Nicholas P. Johns, Lutz, FL (US); Jason Jude Hogg, St. Petersburg, FL (US)

(72) Inventors: Nicholas P. Johns, Lutz, FL (US); Jason Jude Hogg, St. Petersburg, FL (US)

( * ) Notice: Subject to any disclaimer, the term of this patent is extended or adjusted under 35 U.S.C. 154(b) by 0 days.

(21) Appl. No.: 16/906,462

(22) Filed: Jun. 19, 2020

(65) Prior Publication Data

US 2021/0139228 A1 May 13, 2021

Related U.S. Application Data

(63) Continuation of application No. 16/022,109, filed on Jun. 28, 2018, now abandoned, which is a continuation of application No. 14/909,947, filed as application No. PCT/US2014/049723 on Aug. 5, 2014, now abandoned.

(60) Provisional application No. 61/862,312, filed on Aug. 5, 2013.

(51) Int. Cl.
*B65D 83/00* (2006.01)

(52) U.S. Cl.
CPC ..... *B65D 83/0077* (2013.01); *B65D 83/0038* (2013.01)

(58) Field of Classification Search
CPC ..... B65D 83/0077; B65D 83/0038
See application file for complete search history.

(56) References Cited

U.S. PATENT DOCUMENTS 1,342,450 A * 6/1920 Kost ..... B05C 17/0146 222/340
6,050,444 A * 4/2000 Sugg ..... B65D 47/2018 215/229
6,126,043 A * 10/2000 Albert, II ..... B67D 1/0002 222/340
6,382,472 B1 * 5/2002 Shoval ..... B65D 83/0038 222/256
2004/0222229 A1 * 11/2004 Gabbard ..... A47G 19/2272 220/705
2005/0023307 A1 * 2/2005 Wright ..... B67D 1/0001 222/568
2005/0145722 A1 * 7/2005 Wang ..... B05B 9/0838 239/323
2005/0223637 A1 * 10/2005 Black ..... B65D 83/0038 47/57.5
2007/0114250 A1 * 5/2007 Langseder ..... B65D 47/2031 222/494
2008/0257915 A1 * 10/2008 Wold ..... B05B 11/061 222/389

(Continued)

*Primary Examiner* — Bob Zadeh
(74) *Attorney, Agent, or Firm* — Merchant & Gould P.C.

(57) ABSTRACT

Herein is disclosed an apparatus and method for delivering a fluid to an individual in such a manner that sloshing of the fluid is substantially suppressed, even when the fluid has been only partially consumed. The apparatus includes a reservoir for containing the fluid and a valve in fluid communication with the reservoir. A biasing mechanism exerts a force upon the reservoir, causing it to contract and force fluid through the valve, when the valve is opened. The biasing mechanism and reservoir are housed within a body, according to some embodiments.

5 Claims, 5 Drawing Sheets

(56) References Cited

U.S. PATENT DOCUMENTS

| | | | | |
|---|---|---|---|---|
| 2012/0104020 | A1* | 5/2012 | Cur | F25D 23/126<br>222/1 |
| 2013/0047981 | A1* | 2/2013 | Bacon | B01F 13/002<br>128/200.23 |

* cited by examiner

METHOD AND APPARATUS FOR DELIVERING FLUID TO AN INDIVIDUAL

This application is a Continuation of U.S. patent application Ser. No. 16/022,109, filed Jun. 28, 2018, which is a Continuation of U.S. patent application Ser. No. 14/909,947, filed Feb. 3, 2016, which is a National Stage Application of PCT/US2014/049723, filed Aug. 5, 2014, which claims benefit of U.S. Provisional Patent Application No. 61/862,312, filed Aug. 5, 2013, the contents of all of which are hereby incorporated by reference in their entireties.

TECHNICAL FIELD

The present document relates generally to an apparatus and associated methods for delivering a fluid, such as water or a sports drink, to an individual, and more particularly to a scheme for containing and delivering such fluid, so as to suppress a potential sloshing action of the fluid as the container housing the fluid is moved about.

BACKGROUND

Hydration is an essential component of various forms of recreational activities ranging from running to bicycling to rollerblading, for example. Participants in these activities oftentimes carry along containers of liquids so that they can drink fluid as they become dehydrated. Unfortunately, when carried on the person of a runner, bicycler or rollerblader, for example, the fluid within the container tends to slosh as the individual moves about during the course of his physical exertion. Such sloshing action consists of the fluid splashing about the container, causing the center of mass of the combination of the container and the fluid within it to vary with the sloshing of the fluid—a result that is distracting to the participant.

One strategy for suppressing the aforementioned variation in the center of mass is to increase the mass of the container, itself, so that the mobile fluid mass within the container is relatively small in comparison to the mass of the container, itself. While this strategy does suppress variation in the center of mass of the container-fluid combination, it increases the weight of the article that must be carried by the athlete, a result inimical to the goal of athletic performance enhancement.

Another strategy for suppressing the aforementioned variation in the center of mass is to contain fluid in a plurality of containers, each of which is typically contained in pouches fastened to a belt worn about the athlete's waist. If an individual container is sufficiently small, the athlete can consume the entirety of the fluid within the container, thereby preventing the possibility of sloshing. However, even if the sloshing is suppressed, the fluid weight is, at various times, carried asymmetrically about the athlete's body. For example, if the fluid is initially carried in four individual containers, spaced at even ninety degree intervals about the athlete's waist, in the wake of a single bottle having been consumed, the fluid weight will be asymmetrically borne in the direction of the three remaining full bottles. This result tends to interfere with proper performance of athletic motion.

As can be seen from the foregoing, there exists a need for a scheme by which fluid may be contained and delivered to an individual, so as to address the aforementioned issues.

SUMMARY

Against this backdrop, the present invention was developed. According to one embodiment, an apparatus for containing and releasing a fluid includes a reservoir for containing the fluid. The reservoir has an orifice, and a volume. A valve is disposed upon the orifice, so that the fluid must flow through the valve to exit the reservoir. The valve has an open state and a closed state. The apparatus also includes a means for exerting a force upon at least a portion of the reservoir. Exertion of the force upon the reservoir causes the fluid to exit the reservoir through the valve when the valve is in the open state. Additionally, exertion of force upon the reservoir causes the volume of the reservoir to diminish as the fluid exits the reservoir. The reservoir is within an interior surface of a rigid body that is sized to be hand-held.

According to another embodiment, an apparatus includes a body having an outer surface, an inner surface, and a threaded neck. A chamber is defined by the inner surface of the body and a stopper. The stopper is free to slide along the inner surface and forms a seal with the inner surface. A biasing mechanism is situated within the body. The biasing mechanism exerts a force that causes the stopper to slide along the inner surface so as to shrink the chamber as the biasing mechanism relaxes. A threaded top assembly mates with the threaded neck assembly.

According to another embodiment, a method of delivering a fluid to an individual includes the act of containing a fluid within a chamber housed within a body that has an orifice. The method also includes the act of opening a valve coupled to the orifice. Opening of the valve permits a biasing mechanism to relax, thereby shrinking the chamber and causing the fluid to exit the chamber through the valve.

DETAILED DESCRIPTION

Figure 1:
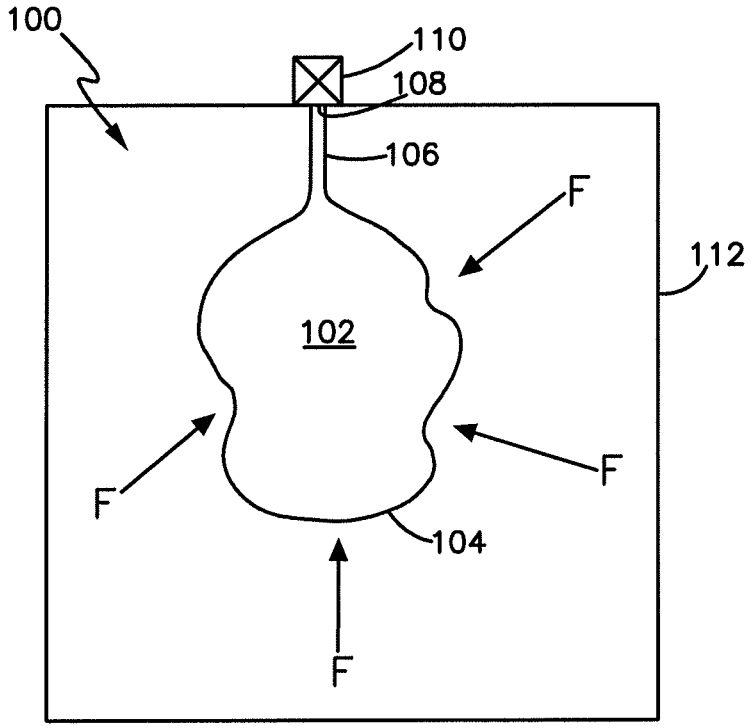
FIG. 1 depicts an apparatus for delivering fluid to an individual, according to an embodiment.

FIG. 1 depicts an apparatus 100 for delivery of a fluid 102 to an individual. The fluid 102 is contained within a chamber or reservoir 104. In principle, the chamber 104 may be of any shape. The chamber or reservoir 104 has a neck 106 and an orifice 108 at the distal end of the neck 106, with the orifice 108 being in fluid communication with the chamber 104. A valve 110 is coupled to the neck 106 at the orifice 108. The valve 110 may be opened or closed. When the valve 110 is opened, the fluid 102 may exit the apparatus 100 along the neck 106, to the orifice 108, and through the valve 110, for delivery to an individual who may drink the fluid 102, if desired. In principle, the valve 110 may be of any variety. According to one embodiment, the valve 110 is a check valve, such as a diaphragm check valve. According to another embodiment, the valve 110 is a ball valve, according to yet another embodiment, the valve 110 is a gate valve, and according to yet another embodiment, the valve 110 is an aerosol valve.

The apparatus 100 is filled with a fluid 102, so that the volume of the fluid 102 is approximately equal to the combined volume of the chamber 104 and neck 106. By virtue of the volumes of the fluid 102 and chamber 104 and neck 106 combination being approximately equal, the opportunity for sloshing of the fluid 102 is diminished, even should the apparatus 100 be physically moved or disturbed, such as would be the case if the apparatus 100 was carried on the person of one who was participating in physical exertion, such as running, bicycling, rollerblading, walking or any other physical endeavor.

A force F is exerted upon the reservoir 104. The chamber 104 is constructed so that when the valve 110 is opened, the force F causes the chamber 104 to contract. Contraction of the chamber 104 causes the fluid 102 to exit the apparatus 100 through the valve 110, as described above. Upon closing of the valve 110, the contraction of the chamber 104 ceases, as does egress of the fluid 102. Accordingly, the volume of the fluid 102 remains approximately equal to the combined volumes of the reservoir 104 and neck 106, meaning that sloshing of the fluid 102 is suppressed, even as the fluid 102 is consumed.

According to some embodiments, the chamber 104 is constructed from a plurality of walls, at least one of which is mobile. The aforementioned force F is applied to the mobile wall, so that, when the valve 110 is open, the mobile wall moves, thereby contracting the volume of the chamber 104, and causing the fluid 102 to exit the apparatus 100 along the neck 106, to the orifice 108, and through the valve 110. According to other embodiments, the chamber 104 is a bladder, and the force F is applied to the bladder, causing the bladder 104 to contract and propelling the fluid 102 to exit the apparatus 100 along the neck 106, to the orifice 108, and through the valve 110. According to some embodiments, the force F is exerted upon the chamber or reservoir 104 by a biasing mechanism, such as one or more excited springs, a pneumatic assembly, or a servo motor.

According to some embodiments, the apparatus 100 includes a body 112. The body 112 contains the reservoir 104 and the biasing mechanism or mechanisms that exert the force F upon the reservoir 104. According to some embodiments, the body 112 is substantially rigid. Further, according to other embodiments, the body 112 is shaped and contoured so as to be conveniently handled by hand.

Figure 2:
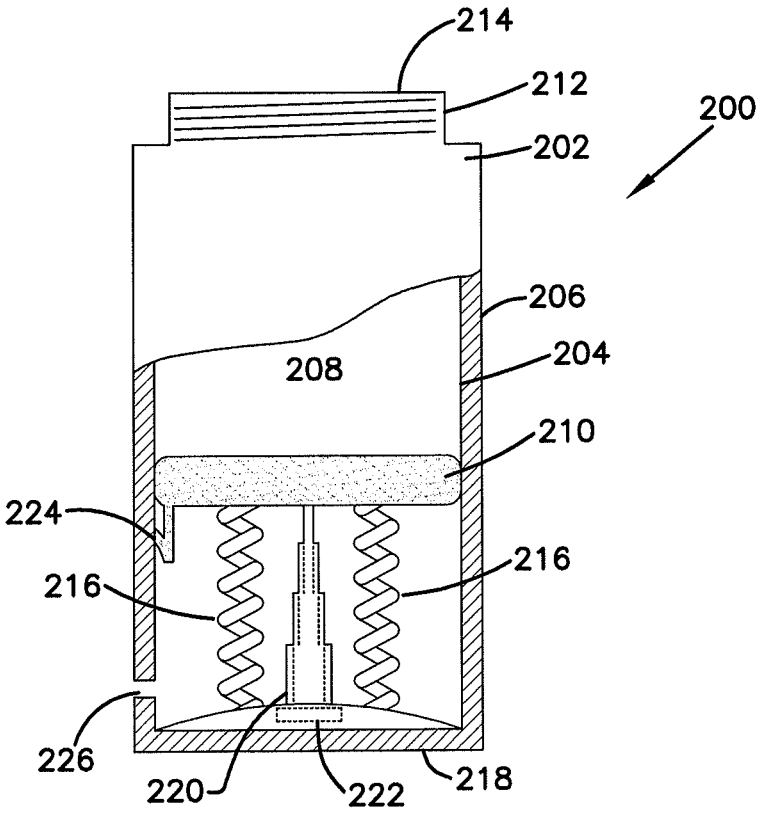
FIG. 2 depicts an apparatus for holding fluid to be delivered to an individual, according to another embodiment.

FIG. 2 depicts an apparatus 200 for holding fluid to be delivered to an individual. According to the embodiment depicted in FIG. 2, the apparatus 200 includes a rigid body 202. The rigid body 202 has an interior surface 204 that is generally cylindrical in shape. According to some embodiments, the outer surface 206 of the body 202 is also cylindrical. The body 202 may be sized to be conveniently held by hand, and the outer surface 206 of the body 202 may include contours to permit convenient gripping.

The apparatus 200 includes a reservoir 208 that is defined by the inner surface 204 of the body 202 and a stopper 210 that serves as a bottom surface of the reservoir 208. The stopper 210 forms a seal with the inner surface 204 of the body 202, so that the reservoir 208 may contain a fluid. The stopper 210 is free to slide along the inner surface 204 of the body 202, and maintains the seal as it does so. The apparatus 200 includes a threaded neck 212 that defines an orifice 214, which with fluid may be introduced into, or withdrawn from, the reservoir 208.

The apparatus 200 includes a biasing mechanism 216 composed of one or more springs 216. When the stopper 210 is positioned toward the bottom surface 218 of the body 202, the springs 216 are compressed. As the springs 216 relax, they urge the stopper 210 toward the neck 212, causing the volume of the reservoir 208 to contract. In the event that the reservoir 208 contains fluid, the fluid is propelled by force through the orifice 214.

Figure 3:
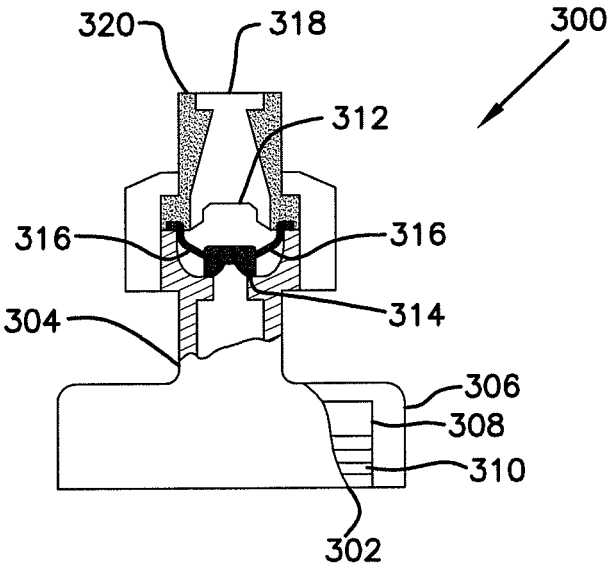
FIG. 3 depicts a top assembly that mates with the body depicted in FIG. 2, according to another embodiment.

FIG. 3 depicts a top assembly 300 that mates with the apparatus 200 depicted in FIG. 2. The top assembly 300 is cut away along lines 302 and 304 to depict it in partial cross section in FIG. 3. As can be seen, the assembly 300 includes a base 306 having an inner surface 308 with threads 310. The threads 310 of the inner surface 308 of the base 306 mate with the threaded neck 212 of the apparatus 200 of FIG. 2. When joined together via the threads 310 and 212, fluid within the reservoir 208 is free to travel through the neck 212, through the orifice 214, and into the interior region of the base 306 of the top assembly 300.

The assembly 300 further includes a check valve that includes a diaphragm 312 and a seat 314. Flanges 316 extend from the diaphragm 312, biasing it against the seat 314. When seated, the diaphragm 312 forms a seal with the seat 314, preventing the fluid from exiting the top assembly 300. When in the presence of a pressure differential across the diaphragm 312, if the differential is of sufficient magnitude, the biasing force of the flanges 316 is overcome, and the diaphragm is withdrawn from the seat 314. Consequently, when the check valve is opened, fluid within the reservoir 208 is free to travel from the reservoir 208, through the neck 212 and its orifice 214, into the inner region of the base 306, around the diaphragm 312 and through the orifice 318 at the upper surface 320 of the top assembly 300. Because the fluid is free to exit the apparatus 200 (through the top assembly 300 as just described) when the check valve is opened, the biasing action of the springs 216 causes the stopper 210 to advance toward the neck 212, thereby contracting the volume of the reservoir 208, and causing fluid contained within the reservoir to exit the apparatus 200 when the check valve is opened. When the check valve is closed, the fluid remains sealed within the combination of the spaces provided by reservoir 208, neck 212 and inner region of the base 306 of the top assembly 300.

According to some embodiments, a telescoping member 220 is coupled to the stopper 210. The telescoping member 222 penetrates the bottom surface 218 of the body 202 and terminates in a handle 222. The user of the apparatus 200 may grab the handle 222, and pull the stopper 210 to a retracted position, thereby compressing or exciting the springs 216 and enlarging the reservoir 208 prior to filling the reservoir 208 with fluid. When the stopper is fully retracted, a flange 224 protrudes through a via 226 and holds the stopper 210 in place. The stopper 210 remains in the fully retracted position until the user of the apparatus 200 pushes the flange 224 through the via 226, thereby freeing the stopper 210 to slide along the inner surface 204 of the body 202. The stopper 210 will slide along the inner surface 204 toward the neck 212 when the diaphragm 312 is withdrawn from the seat 314, and will remain in place when the diaphragm 312 is seated. By virtue of sliding toward the neck 212, the stopper 210, motivated by the springs 216, contracts the volume of the reservoir 208, causing the fluid to exit the reservoir 208, and creating a condition in which, during use, the volume of the reservoir 208 is substantially equal to the volume of the fluid contained in the reservoir, meaning that the opportunity for the fluid to slosh is diminished.

Figure 4:
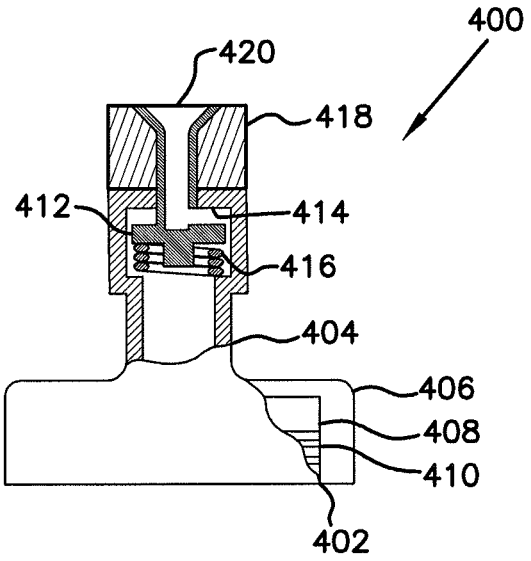
FIG. 4 depicts another top assembly that mates with the body depicted in FIG. 2, according to another embodiment.

FIG. 4 depicts another top assembly 400 that mates with the apparatus 200 depicted in FIG. 2. The top assembly 400 is cut away along lines 402 and 404 to depict it in partial cross section in FIG. 4. As can be seen, the assembly 400 includes a base 406 having an inner surface 408 with threads 410. The threads 410 of the inner surface 408 of the base 406 mate with the threaded neck 212 of the apparatus 200 of FIG. 2. When joined together via the threads 410 and 212, fluid within the reservoir 208 is free to travel through the neck 212, through the orifice 214, and into the interior region of the base 406 of the top assembly 400.

The assembly 400 further includes a valve that includes a valve body 412 and a seat 414. Springs 416 bias the valve body 412 toward the seat 414 to keep it closed (although the valve is depicted in an opened position in FIG. 4). When seated, the valve body 412 forms a seal with the seat 414, preventing the fluid from exiting the top assembly 400. When the head 418 of the assembly 400 is depressed (as it is in FIG. 4), the biasing force of the springs 316 is overcome, and the valve body 412 is forced away from the seat 414. Consequently, when the valve is opened, fluid within the reservoir 208 is free to travel from the reservoir 208, through the neck 212 and its orifice 214, into the inner region of the base 406, around the valve body 412 and through the orifice 420 on the head 418 of the top assembly 400. Because the fluid is free to exit the apparatus 200 (through the top assembly 400 as just described) when the valve is opened, the biasing action of the springs 216 causes the stopper 210 to advance toward the neck 212, thereby contracting the volume of the reservoir 208, and causing fluid contained within the reservoir 208 to exit the apparatus 200 when the valve is opened. When the valve is closed, the fluid remains sealed within the combination of the spaces provided by reservoir 208, neck 212 and inner region of the base 406 of the top assembly 400.

Figure 5:
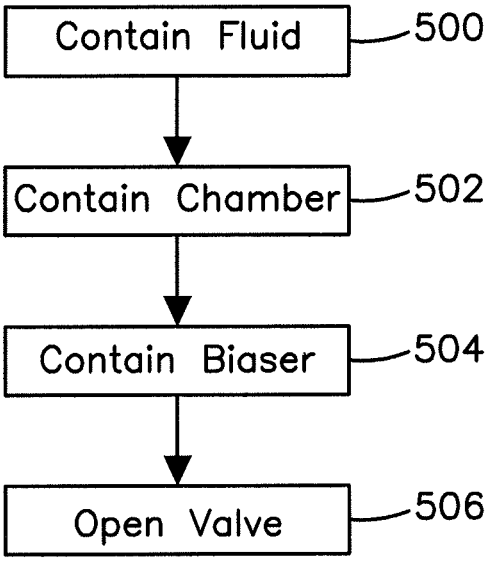
FIG. 5 depicts a method for delivering fluid to an individual, according to another embodiment.

FIG. 5 depicts a method for delivering fluid to an individual, according to another embodiment. The method of FIG. 5 begins by containing the fluid within a chamber that has an orifice, as is shown in operation 500. In operation 502, the chamber, itself, it contained within a body, which, according to some embodiments, may be a substantially rigid body. In operation 504, a biasing mechanism, such as one or more springs, a pneumatic arrangement, a motor, one or more elastic bands, to name a few without limitation, is also contained within the rigid body. The biasing mechanism exerts a force upon the chamber housing the fluid, and as the biasing mechanism is permitted to relax, it causes the chamber to contract, thereby causing the volume of the chamber to contract as the volume of the fluid held within the chamber is diminished. To deliver the fluid to the individual, a valve in fluid communication with the orifice is opened, as shown in operation 506. By opening the valve, the biasing mechanism is permitted to relax, causing the fluid to exit the chamber, as just described.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

The claimed invention is:

1. An apparatus comprising:

a cylindrical rigid body having an outer surface, an inner surface, and a threaded neck, the threaded neck including an orifice, the body having a via extending therethrough;

a valve in fluid communication with the orifice, wherein the valve has an open state and a closed state;

a chamber defined by the inner surface of the body and a stopper, the stopper being free to slide along the inner surface and forming a seal with the inner surface, wherein the stopper is slidable from a first position a first distance from the orifice in which a volume of the chamber is at a maximum level to a second position closer to the orifice in which the volume of the chamber is reduced;

a biasing mechanism situated within the body, the biasing mechanism exerting a force that causes the stopper to slide along the inner surface from the first position towards the second position to shrink the chamber as the biasing mechanism relaxes;

a flange having a first end connected to a bottom surface of the stopper opposite the chamber, the flange extending parallel to an axis of the chamber in a direction opposite the orifice, wherein a second end of the flange is received in the via when the stopper in the first position; and a threaded top assembly that mates with the threaded neck.

2. The apparatus of claim 1, wherein the biasing mechanism comprises a spring.

3. The apparatus of claim 1, further comprising:

a member coupled to the stopper configured to selectively cause the stopper to slide along the inner surface of the body from the second position to the first position, so as to expand the chamber and cause the biasing mechanism to transition into a higher energy state.

4. The apparatus of claim 3, wherein the member comprises a telescoping rod.

5. The apparatus of claim 1, wherein the body is handheld sized.

* * * * *